US007851117B2

(12) United States Patent
Yodo et al.

(10) Patent No.: US 7,851,117 B2
(45) **Date of Patent: *Dec. 14, 2010**

(54) LIQUID DEVELOPER

(75) Inventors: Takaaki Yodo, Osaka (JP); Katsutoshi Okamoto, Osaka (JP); Hideo Shibata, Osaka (JP); Koji Iwase, Osaka (JP)

(73) Assignee: Sakata Inx Corp., Osaka-shi (JP)

( * ) Notice: Subject to any disclaimer, the term of this patent is extended or adjusted under 35 U.S.C. 154(b) by 144 days.

This patent is subject to a terminal disclaimer.

(21) Appl. No.: 12/095,042

(22) PCT Filed: Nov. 24, 2006

(86) PCT No.: PCT/JP2006/323488

§ 371 (c)(1),
(2), (4) Date: Oct. 10, 2008

(87) PCT Pub. No.: WO2007/061072

PCT Pub. Date: May 31, 2007

(65) Prior Publication Data

US 2009/0246678 A1 Oct. 1, 2009

(30) Foreign Application Priority Data

Nov. 28, 2005 (JP) ..... 2005-342470

(51) Int. Cl.
*G03G 9/12* (2006.01)

(52) U.S. Cl. ..... 430/115; 430/112; 430/114; 430/118.6; 430/137.22

(58) Field of Classification Search ..... 430/115, 430/112, 114, 118.6, 137.22
See application file for complete search history.

(56) References Cited

U.S. PATENT DOCUMENTS

| | | | | |
|---|---|---|---|---|
| 5,529,874 | A * | 6/1996 | Kobayashi et al. | 430/116 |
| 5,723,250 | A * | 3/1998 | Matsuoka et al. | 430/117.4 |
| 2004/0006159 | A1 * | 1/2004 | Horie et al. | 523/160 |
| 2009/0011359 | A1 * | 1/2009 | Iwase et al. | 430/115 |

FOREIGN PATENT DOCUMENTS

| | | | |
|---|---|---|---|
| JP | 04-073664 | A | 3/1992 |
| JP | 2001-31900 | A | 2/2001 |
| JP | 2006-257243 | A | 9/2006 |
| WO | 2006-118201 | A1 | 11/2006 |

* cited by examiner

*Primary Examiner*—Hoa V Le
(74) *Attorney, Agent, or Firm*—Westerman, Hattori, Daniels & Adrian, LLP

(57) ABSTRACT

It is an object of the present invention to provide a liquid developer in which in liquid developers for electrophotography or electrostatic recording obtained using the coacervation method, electric resistance of the liquid developer and the electrophoretic property or the charging characteristic of the toner particles are adequately maintained, and the dispersibility of a pigment and the dispersion stability of the toner particles are good.

A liquid developer formed by dispersing colored resin particles comprising at least a pigment, a dispersant and a resin in a hydrocarbon insulating medium using a coacervation method, wherein said dispersant is a carbodiimide compound having at least one basic nitrogen-containing group and at least one polyester side chain introduced through a reaction with a carbodiimide group in its molecule, and said resin is an acid group-containing resin and the acid value of the resin is 1 to 100.

8 Claims, No Drawings

LIQUID DEVELOPER

TECHNICAL FIELD

The present invention relates to a liquid developer for electrophotography or electrostatic recording used in printing machines, copiers, printers and facsimiles.

BACKGROUND ART

As a liquid developer, generally, liquid developers in which colored resin particles (hereinafter, also referred to as toner particles) containing a coloring agent such as a pigment are dispersed in an electrical insulating medium are used. Examples of a method of producing such a liquid developer include a coacervation method. The coacervation method is a method in which a solvent is removed from a mixed liquid of a solvent in which a resin is dissolved and an electrical insulating medium in which a resin is not dissolved, and thereby the resin contained in the mixed liquid in a dissolved state is precipitated so as to encapsulate a coloring agent to form colored resin particles, and the colored resin particles are dispersed in the electrical insulating medium.

The liquid developers obtained by such a method are considered to improve in an electrophoretic property because the shape of the colored resin particle is almost spherical and the particle size of the colored resin particles is uniform.

However, the coacervation method has a problem that the colored resin particles tend to agglomerate during the precipitation of the resin and therefore the dispersion stability and the optical properties of the developer to be obtained are inadequate due to an increase in particle size.

Therefore, in order to solve the problem, in the coacervation method, a method, in which the colored resin particles are dispersed stably in the electrical insulating medium by adsorbing one of a polymer compound having an acid group and a polymer compound having a basic group on the surface of the coloring agent and further encapsulating the resulting coloring agent adsorbing one polymer compound in the other polymer compound, has been proposed (for example, see Patent Document 1).

However, the above-mentioned method itself is a technology based on a hitherto well known concept of acid-base interaction in which dispersion is stabilized by treating the surface of the pigment with a compound having one of an acid group and a basic group to enhance an affinity for a resin having the other group. In addition, disclosed compounds are merely substances very commonly used such as an acrylic resin, a styrene-acrylic resin and the like, and effects of improving adequately the dispersibility of fine colored resin particles cannot be expected. Further, there is a problem that these compounds cause a reduction in an insulating property or deterioration in a charging characteristic and an electrophoretic property of the colored resin particles, and a good image quality cannot be attained in terms of suitability for the liquid developer.

Patent Document 1: Japanese Kokai Publication 2001-31900

DISCLOSURE OF THE INVENTION

Problem to be Solved by the Invention

It is still the case that a liquid developer thus obtained by the coacervation method, which achieves a balance between maintenance of an electrophoretic property or a charging characteristic of the toner particles and the dispersibility of the toner particles at a high level, has a good insulating property and can be applied to a coloring agent with any color, has not been found yet.

Therefore, it is an object of the present invention to provide a liquid developer in which in liquid developers for electrophotography or electrostatic recording obtained using the coacervation method, electric resistance of the liquid developer and the electrophoretic property or the charging characteristic of the toner particles are adequately maintained, and the dispersibility of a pigment and the dispersion stability of the toner particles are good.

Means for Solving the Problem

The present inventors made earnest investigations in order to solve the above-mentioned problems, and consequently found that by using the following specific dispersant and further using a resin having an acid group in order to disperse a pigment, the colored resin particles can be applied to a liquid developer without particularly depending on the species of a pigment, and the adverse effect on the electric resistance of the liquid developer and the electrophoretic property or the charging characteristic of the colored resin particles as the toner particles can be minimized, and the dispersibility of the pigment and the dispersion stability of the toner particles can be outstandingly improved. These findings have now led to completion of the present invention. The present invention completely differs from the technology based on a hitherto known acid-base interaction and enables the liquid developer to minimize the adverse effect on its electric resistance and the electrophoretic property or the charging characteristic of the toner particles and to achieve good effects on the dispersibility of the pigment and the dispersion stability of the toner particles.

That is, the present invention pertains to (1) a liquid developer formed by dispersing colored resin particles comprising at least a pigment, a dispersant and a resin in a hydrocarbon insulating medium using the coacervation method, wherein the dispersant is a carbodiimide compound having at least one basic nitrogen-containing group and at least one polyester side chain introduced through a reaction with a carbodiimide group in its molecule, and the resin is an acid group-containing resin and the acid value of the resin is 1 to 100.

In addition, the present invention pertains to (2) the liquid developer according to the above-mentioned (1), wherein the dispersant is a carbodiimide compound containing a basic nitrogen-containing group in an amount of 0.02 to 4 mmol per 1 g of the compound.

Further, the present invention pertains to (3) the liquid developer according to the above-mentioned (1) or (2), wherein the dispersant is a carbodiimide compound having a basic nitrogen-containing group on the main chain.

Further, the present invention pertains to (4) the liquid developer according to any one of the above-mentioned (1) to (3), wherein the basic nitrogen-containing group is a tertiary amino group.

Further, the present invention pertains to (5) the liquid developer according to any one of the above-mentioned (1) to (4), wherein the dispersant is a carbodiimide compound with a carbodiimide equivalent weight of 100 to 50000.

Further, the present invention pertains to (6) the liquid developer according to any one of the above-mentioned (1) to (5), wherein the resin is a carboxyl group-containing resin.

Further, the present invention pertains to (7) the liquid developer according to any one of the above-mentioned (1) to (6), wherein the hydrocarbon insulating medium is a high boiling point paraffin having a boiling point of 150° C. or higher.

Further, the present invention pertains to (8) a method of producing the liquid developer according to any one of the above-mentioned (1) to (7), comprising the step of obtaining a mixed liquid containing at least a pigment, a dispersant, a resin, an organic solvent for dissolving the resin and a hydrocarbon insulating medium, and the step of distilling off the organic solvent contained in the mixed liquid, wherein the dispersant is a carbodiimide compound having at least one basic nitrogen-containing group and at least one polyester side chain introduced through a reaction with a carbodiimide group in its molecule, and the resin is an acid group-containing resin and the acid value of the resin is 1 to 100.

Hereinafter, the liquid developer of the present invention will be described in detail.

Examples of the pigment used in the present invention include inorganic pigments and organic pigments, and specific examples of them include inorganic pigments such as acetylene black, graphite, red iron oxide, chrome yellow, ultramarine blue, carbon black and the like; and organic pigments such as an azo pigment, a lake pigment, a phthalocyanine pigment, an isoindoline pigment, an anthraquinone pigment, a quinacridone pigment and the like.

The pigment is preferably a pigment having an adsorption site on the basic nitrogen-containing group of the carbodiimide compound described later, and the adsorption site is typically an acid group, and preferably a functional group capable of reacting with the basic nitrogen-containing group, such as a carboxyl group, a sulfonic acid group or the like. In addition, even a pigment not having an adsorption site on the basic nitrogen-containing group can be utilized by treating by a normal method of introducing a functional group such as a derivative treatment or a sulfonation treatment of the surface of a pigment to introduce the carboxyl group or the sulfonic acid group.

The pigment is preferably a pigment further having a functional group capable of reacting with the carbodiimide group when a carbodiimide compound described later has the carbodiimide group. Herein, as the functional group capable of reacting with the carbodiimide group, at least one functional group selected from the group consisting of a carboxyl group, a hydroxyl group, a phosphoric acid group and an amino group is preferable. In addition, even in the pigment not having the functional group capable of reacting with the carbodiimide group, the functional group can be introduced by a surface treatment, and for example, the functional group capable of reacting with the carbodiimide group can be introduced by a plasma treatment or a oxygen/ultraviolet light treatment described in "Techniques and Evaluations of Pigment Dispersion Stabilization and Surface Treatment" (1st edition, TECHNICAL INFORMATION INSTITUTE CO., LTD., Dec. 25, 2001, p. 76-85), or a low temperature plasma process described in Japanese Kokai Publication Sho-58-217559 besides the derivative treatment or the sulfonation treatment.

In the present invention, the content of the pigment is not particularly limited, however, from the viewpoint of an image density, the pigment content is preferably 2 to 20% by weight in the liquid developer ultimately.

Next, the resin to be used in the present invention is an acid group-containing resin and the acid value of the resin is 1 to 100. As the resin, a thermoplastic resin having a fixing property to an adherend such as paper for printing is preferable. Specific examples of the resin include resins obtained by introducing an acid group such as a carboxyl group, a sulfonic acid group or a phosphoric acid group into olefin resins such as an ethylene-(meth) acrylic acid copolymer, an ethylene-vinyl acetate copolymer, a partially saponified product of an ethylene-vinyl acetate copolymer, an ethylene-(meth)acrylate copolymer, a polyethylene resin and a polypropylene resin; a thermoplastic saturated polyester resin; styrenic resins such as a styrene-acrylic copolymer resin and a styrene-acryl modified polyester resin; an alkyd resin, a phenolic resin, an epoxy resin, a rosin modified phenolic resin, a rosin modified maleic resin, a rosin modified fumaric acid resin, acrylic resins such as an (meth)acrylate resin, a vinyl chloride resin, a vinyl acetate resin, a vinylidene chloride resin, fluororesins, polyamide resins, or a polyacetal resin by a method of using a carboxylic acid compound as a polymerization material or an addition material, by a treatment with peroxides, or the like. In addition, these resins may be used singly or in combination of two or more species. As the above-mentioned resin, a carboxyl group-containing resin is preferable. Further, as the resin to be used in the present invention, the acid group-containing resin and a resin not containing an acid group may be used in combination.

If the acid value of the resin is less than 1 or more than 100, it is not preferable since the pigment particles, which are dispersed by virtue of the dispersant in a system where a good solvent is distilled off and a large amount of a poor solvent exists, become hard-to-embed in the resin and consequently particles including only a resin are produced in the system. The acid value of the resin is preferably 10 to 80.

A weight average molecular weight of the resin is preferably 5000 to 100000. If the weight average molecular weight is less than 5000, it is not preferable since the pigment particles, which are dispersed by virtue of the dispersant in a system where a good solvent is distilled off and a large amount of a poor solvent exists, become hard-to-embed in the resin and consequently particles including only a resin are produced in the system. Further, if the weight average molecular weight is more than 100000, it is not preferable from the viewpoint of melt viscosity of the resin. The value of the weight average molecular weight can be obtained by the same method as a measuring method of a number average molecular weight described later.

Next, the dispersant to be used in the present invention is the carbodiimide compound having at least one basic nitrogen-containing group and at least one polyester side chain introduced through a reaction with a carbodiimide group in its molecule.

In the following description, a chain in a state of being branched from a carbodiimide compound-derived portion, which is formed by reacting the carbodiimide group of the carbodiimide compound with a compound having a group reactive with the carbodiimide group, may be referred to as a "side chain". In the present invention, the carbodiimide compound-derived portion is referred to as a "main chain" and all chains in a state of being branched from the main chain are referred to as a "side chain" regardless of the size of a chain structure.

The carbodiimide compound of the present invention may be a compound in which all carbodiimide groups have been reacted with another functional group in order to introduce a polyester side chain or a basic nitrogen-containing group, or may be a compound having unreacted carbodiimide groups, however, the compound having unreacted carbodiimide groups is preferable.

1) Material for Synthesizing a Carbodiimide Compound

First, a carbodiimide compound being a starting material, a compound for introducing a polyester side chain and a compound for introducing a basic nitrogen-containing group will be described as essential constituent materials of the carbodiimide compound of the present invention.

1-1) Carbodiimide Compound

The carbodiimide compound used as a starting material in order to obtain the carbodiimide compound of the present invention has at least one carbodiimide group, namely, a group expressed by the formula —N=C=N— in a molecule, and such a carbodiimide compound will be described in more detail by exemplification of the preferred forms of the following paragraphs (a) to (d). The carbodiimide compound is appropriately selected according to the form of the compound to be used.

(a) Carbodiimide Compound Having an Isocyanate Group, which is Obtained by a Decarboxylation Reaction of a Diisocyanate Compound The carbodiimide compound can be generally produced by converting the isocyanate compound to carbodiimide by a decarboxylation reaction in the presence of a carbodiimidation catalyst in an organic solvent, and further a carbodiimide compound having isocyanate groups at both ends of a molecule is obtained when its material is a diisocyanate compound.

In the above-mentioned production method, examples of the diisocyanate compound, which is subjected to the decarboxylation reaction, include aliphatic, alicyclic, aromatic or araliphatic diisocyanate compounds such as hexamethylene diisocyanate, isophorone diisocyanate, trilene diisocyanate, diphenylmethane diisocyanate, cyclohexane diisocyanate, dicyclohexylmethane diisocyanate, xylylene diisocyanate, tetramethylene diisocyanate and tetramethylxylylene diisocyanate.

As the above-mentioned organic solvent, a solvent having a high boiling point and not having active hydrogen which reacts with an isocyanate compound and a produced carbodiimide compound is preferably used, and examples of the solvents include aromatic hydrocarbons such as toluene, xylene and diethyl benzene; glycol ether esters such as diethylene glycol diacetate, dipropylene glycol dibutylate, hexylene glycol diacetate, glycol diacetate, methyl glycol acetate, ethyl glycol acetate, butyl glycol acetate, ethyl diglycol acetate and butyl diglycol acetate; ketones such as ethyl butyl ketone, acetophenone, propiophenone, diisobutyl ketone and cyclohexanone; and fatty acid esters such as amyl acetate, propyl propionate and ethyl butyrate.

As the above-mentioned carbodiimidation catalyst, phospholenes or phospholene oxides are preferably used, and examples of them include 1-ethyl-3-methyl-3-phospholene oxide, 1-phenyl-3-methyl-3-phospholene oxide, and 1-phenyl-3-methyl-2-phospholene oxide.

As a method of performing a decarboxylation reaction of an isocyanate group using these materials, known methods can be employed, for example, a method of performing the reaction at a reaction temperature of 100 to 200° C. in a nitrogen atmosphere. Incidentally, examples of other methods of obtaining the compound having a carbodiimide group include the methods of U.S. Pat. No. 2,941,956, Japanese Kokoku Publication No. Sho-47-33279, Japanese Kokai Publication No. Hei-5-178954, and Japanese Kokai Publication No. Hei-6-56950.

With respect to a carbodiimide compound having an isocyanate group, which is obtained by using such production methods, for example, a compound which is obtained by decarboxylating K moles (K is an integer of 2 or more) of a diisocyanate compound is expressed by the following formula (1):

$$OCN\text{-}(A\text{-}N{=}C{=}N)_{K-1}\text{-}A\text{-}NCO \quad (1),$$

wherein A represents a residue which is the rest after eliminating an isocyanate group from the diisocyanate compound used for synthesis of a carbodiimide compound having an isocyanate group.

Examples of commercially available products of a carbodiimide compound having an isocyanate group, expressed by the formula (1), include CARBODILITE V-03 and CARBODILITE V-05 (both are trade names, manufactured by NISSHINBO INDUSTRIES, INC.) as a carbodiimide compound made from a raw material of tetramethylxylylene diisocyanate.

(b) Carbodiimide Compound Obtained by Further Chain-Extending the Carbodiimide Compound Described in the Above-Mentioned (a) with a Chain Extender The carbodiimide compound is formed by increasing a molecular weight of the carbodiimide compound of the above-mentioned (a) using a chain extender capable of reacting with an isocyanate group and it can be converted to a compound containing more carbodiimide groups in a molecule. As the chain extender which can be used in this case, a compound having low reactivity with a carbodiimide group and selectively reacting with an isocyanate group first is preferable, and examples of the compound include diol compounds such as 2,4-diethyl-1,5-pentanediol and the like, diamine compounds, and hydrazine.

(c) Compound Obtained by Decarboxylating 2 Moles of a Monoisocyanate Compound and Q Moles (Provided that Q≧1) of a Diisocyanate Compound The carbodiimide compounds in the above-mentioned (a) and (b) are each a compound having isocyanate groups at both ends of a molecule, and have advantages that various molecular chains can be added by use of the isocyanate group, however, they have a problem that when a material to be reacted with the carbodiimide group also reacts with the isocyanate group, it is difficult to introduce this material as a side chain. On the other hand, in the carbodiimide compound in which reactions of both ends of a molecule are terminated with a monoisocyanate compound, the above-mentioned problem does not arise. Such a carbodiimide compound in which reactions of both ends of a molecule are terminated with a monoisocyanate compound can be expressed by the following formula (2):

$$B{-}N{=}C{=}N\text{-}(A\text{-}N{=}C{=}N)_{Q}{-}B \quad (2),$$

wherein B represents a residue which is the rest after eliminating an isocyanate group from the monoisocyanate compound used for synthesis of a carbodiimide compound having an isocyanate group. A is as described above.

Examples of the diisocyanate compound which can be used here include the same compounds as those of synthetic materials in the above-mentioned (a). Examples of the monoisocyanate compound include aliphatic, alicyclic, aromatic or araliphatic monoisocyanate compounds such as methyl isocyanate, ethyl isocyanate, propyl isocyanate, butyl isocyanate, octadecyl isocyanate and phenyl isocyanate.

(d) Compound Obtained by Decarboxylating 1 Mole of a Monoisocyanate Compound and R Moles (Provided that R≧1) of a Diisocyanate Compound As an intermediate compound between a carbodiimide compound having isocyanate groups at both ends of a molecule and a carbodiimide compound not having an isocyanate group at both ends of a molecule, a carbodiimide compound, in which a reaction of just one end is terminated with a monoisocyanate compound and an isocyanate group is positioned at the other end, can also be obtained. Such a carbodiimide compound in which a reaction of one end of a molecule is terminated with a monoisocyanate compound can be expressed by the following formula (3):

$$OCN\text{-}(A\text{-}N{=}C{-}N)_R{-}B \quad (3),$$

wherein B represents a residue which is the rest after eliminating an isocyanate group from the monoisocyanate compound used for synthesis of a carbodiimide compound having an isocyanate group. A is as described above.

Examples of the diisocyanate compound which can be used here include the same compounds as those of synthetic materials in the above-mentioned (a), and examples of the monoisocyanate compound include the same compounds as those of synthetic materials in the above-mentioned (c).

The carbodiimide compounds in the above-mentioned (a) to (d) may be used singly or in combination of two or more species as a starting material of the carbodiimide compound.

1-2) Compound for Introducing a Polyester Side Chain

Next, a compound used for introducing a polyester side chain into the carbodiimide compound will be described.

The carbodiimide compound of the present invention is characterized by using a method of introducing a side chain by reaction of the carbodiimide group with a functional group reactive with the carbodiimide group and characterized in that this side chain is a polyester side chain. Therefore, as the compound introduced as a side chain, polyester compounds having a functional group reactive with the carbodiimide group and a polyester chain can be used.

Examples of the functional group reactive with the carbodiimide group include a carboxyl group, a sulfonic acid group, a phosphoric acid group, a hydroxyl group and an amino group, and this functional group is preferably an acid group such as a carboxyl group, a sulfonic acid group, or a phosphoric acid group.

First, examples of the polyester compound include (1) ring-opening polymerization compounds of a cyclic ester compound using oxycarboxylic acid, monoalcohol or a low molecular weight diol compound as an initiator (for example, polyester compounds containing a carboxyl group and a hydroxyl group, which are obtained by polymerizing by ring-opening cyclic ester compounds such as ε-caprolactone, γ-butyrolactone, 2-methylcaprolactone, 4-methylcaprolactone, β-propiolactone, δ-valerolactone and β-methyl-δ-valerolactone, using a monooxycarboxylic acid or a polyoxycarboxylic acid such as lactic acid, caproic acid, 12-hydroxystearic acid, dimethylolpropionic acid or dimethylolbutanoic acid as a initiator; polyester monool compounds containing a hydroxyl group, which are obtained by polymerizing by ring-opening the above-mentioned cyclic ester compounds, using a low molecular weight monool compound such as methanol or ethanol as an initiator; and polyester diol compounds containing a hydroxyl group, which are obtained by polymerizing by ring-opening the above cyclic ester compounds, using a low molecular weight diol compound such as ethylene glycol or propylene glycol as an initiator).

Examples of the polyester compound include (2) self-polycondensates of hydroxycarboxylic acid (for example, polyester compounds containing a carboxyl group and a hydroxyl group, which are obtained by polycondensing monooxycarboxylic acids such as lactic acid, caproic acid and 12-hydroxystearic acid).

Other examples of the polyester compound include (3) compounds obtained by polycondensing a low molecular weight diol compound and a low molecular weight dicarboxylic acid compound (for example, polyester diol compounds containing a hydroxyl group, which are obtained by reacting a low molecular weight diol compound component such as straight-chain glycols like ethylene glycol, 1,3-propanediol, 1,4-butanediol or 1,6-hexanediol; or branched glycols like 1,2-propanediol, neopentyl glycol, 3-methyl-1,5-pentanediol or ethylbutylpropanediol with a low molecular weight dicarboxylic acid compound component such as saturated or unsaturated aliphatic dicarboxylic acids like succinic acid, adipic acid, azelaic acid, sebacic acid or maleic acid; or aromatic dicarboxylic acids like phthalic acid in the presence of an excessive low molecular weight diol compound).

Furthermore, examples of the polyester compound include (4) phosphate compounds of a ring-opening polymer of a cyclic ester compound using monoalcohol as an initiator (for example, polyester diol compounds containing a phosphoric acid group, which are obtained by esterifying the polyester monool compounds with phosphoric acid), and (5) ring-opening polymerization compounds of a cyclic ester compound using an amino group-containing sulfonic acid compound as an initiator (for example, polyester diol compounds containing sulfonic acid, which are obtained by ring-opening polymerization of the cyclic ester compounds, using an amino group-containing sulfonic acid compound such as taurine as an initiator).

Furthermore examples of the polyester compound include (6) sulfur dioxide adduct of a ring-opening polymer of a cyclic ester compound using monoalcohol as an initiator (for example, polyester diol compounds containing sulfonic acid, which are obtained by adding sulfur dioxide gas to the polyester monool compounds).

As the polyester compound, a polyester compound having a self-polycondensate of hydroxycarboxylic acid is preferable, and a polyester compound having 12-hydroxystearic acid is more preferable.

In addition, the carbodiimide compound of the present invention is preferably one in which a number average molecular weight of the polyester side chain is 200 to 10000. The number average molecular weight in the present invention is provided based on a gel permeation chromatography (GPC) method <polystyrene equivalent basis>, and Water 2690 (manufactured by Nihon Waters K. K.) is used as a measuring apparatus and PLgel 5μ MIXED-D (manufactured by Polymer Laboratories) is used as a column.

1-3) Material for Introducing a Basic Nitrogen-Containing Group

The carbodiimide compound of the present invention further has a basic nitrogen-containing group. The "basic nitrogen-containing group" includes a group containing nitrogen to act as a Lewis base as well as a group containing nitrogen to form a quaternary ammonium ion in water, and a typical group thereof is an amino group and a basic nitrogen-containing heterocyclic group. Examples of the amino group include a tertiary amino group. As the basic nitrogen-containing group, the tertiary amino group is preferred.

Examples of a method of obtaining such a carbodiimide compound having a basic nitrogen-containing group include a method of reacting a compound having a functional group capable of reacting with the carbodiimide group and a basic nitrogen-containing group with the carbodiimide group to introduce the basic nitrogen-containing group into the side chain; and a method of reacting a compound having a functional group capable of reacting with the isocyanate group and a basic nitrogen-containing group with the isocyanate group to introduce the basic nitrogen-containing group into the main chain in the case where the carbodiimide compound has an isocyanate group.

Examples of the functional group reactive with the carbodiimide group include the functional groups described above for the polyester compound, and examples of the functional group reactive with the isocyanate group include a hydroxyl group and an amino group.

The method of introducing the basic nitrogen-containing group into the main chain of the carbodiimide compound by use of the reaction with the isocyanate group is one of suitable methods. When the basic nitrogen-containing group is introduced into the carbodiimide compound, it is preferable to use a compound having a hydroxyl group which is suitable as a functional group capable of reacting selectively with the isocyanate group, and a tertiary amino group or a basic nitrogen-containing heterocyclic group which does not concern the reaction with the carbodiimide group or the isocyanate group.

Specific examples of compounds having a hydroxyl group and a tertiary amino group include N,N-dialkylalkanolamine compounds such as N,N-dimethylethanolamine and N,N-diethylethanolamine; ethylene oxide adducts of secondary amine compounds; and reaction products of a secondary amine compound and an epoxy compound.

Examples of compounds having two hydroxyl groups and a tertiary amino group include N-alkyldialkanolamine compounds such as N-methyldiethanolamine and N-ethyldiethanolamine; ethylene oxide adducts of primary amine compounds; and reaction products of a primary amine compound and an epoxy compound.

Further, examples of the compound having a hydroxyl group and a basic nitrogen-containing heterocyclic group include compounds which has a heterocycle containing tertiary basic nitrogen, like pyridine, pyrazine, triazine or quinoline has, and a hydroxyl group, more specifically, hydroxypyridine, pyridinemethanol, and pyridineethanol. Even a heterocyclic compound containing secondary basic nitrogen such as piperidine or piperazine can be used by alkylating and converting the compound to a tertiary compound to contain a hydroxyl group.

The basic nitrogen-containing group may be introduced into the end of the main chain by reacting 2 moles of a compound having a hydroxyl group with 1 mole of the carbodiimide compound expressed by the formula (1), or the basic nitrogen-containing group may be introduced into the main chain by reacting a compound having two hydroxyl groups with the carbodiimide compound expressed by the formula (1) in such an amount that the isocyanate group is in excess of the hydroxyl group. Such a compound in which the basic nitrogen-containing group is introduced into the main chain thereof is a more preferable compound.

Further, in the reactions described above, that is, the ring-opening reaction of a cyclic ester compound using the hydroxyl group-containing compound as an initiator, the polycondensation reaction of oxycarboxylic acid, the polycondensation reaction between a low molecular weight diol compound and a low molecular weight dicarboxylic acid compound, the reaction between the carbodiimide group and a carboxyl group, a sulfonic acid group, a phosphoric acid group, a hydroxyl group, an amino group or the like, and furthermore the reaction between the isocyanate group and a hydroxyl group, an amino group or the like, normal methods can be used.

2) Molecular Structure and Effect of Carbodiimide Compound

The carbodiimide compound of the present invention is obtained from the above-mentioned materials, and the material to be introduced as the polyester side chain is introduced into the carbodiimide compound as a starting material through the reaction with the carbodiimide group, and the material for introducing the basic nitrogen-containing group is introduced through the reaction with the carbodiimide group or the isocyanate group.

For example, when a compound having a structure of the formula (1) is used as a carbodiimide compound, a starting material, such a carbodiimide compound can be schematically expressed by the following formula (4):

$$OCN—X_{(L)}—(N{=}C{=}N)_{(N-L)}—OCN \quad (4),$$

wherein X independently denotes a constituent unit containing a polyester side chain bonded through a linking group formed by reaction of the carbodiimide group with the functional group reactive therewith, L denotes the number of the constituent units X in one molecule and an integer of one or more, N denotes the number of carbodiimide groups in the carbodiimide compound as a starting material and an integer of one or more, and (N-L) denotes an integer of 0 or more. A is omitted in this formula.

Further, as for the introduction of the basic nitrogen-containing group, a method of introducing the basic nitrogen-containing group through a reaction with either the carbodiimide group or the isocyanate group can be employed. For example, when a compound having a structure of the formula (1) is used as a carbodiimide compound of a starting material, such a carbodiimide compound can be schematically expressed by the following formula (5):

$$Y—X_{(L)}—Z_{(M)}—(N{=}C{=}N)_{(N-L-M)}—Y \quad (5)$$

wherein X, L and N can be respectively defined as described above, Y independently denotes a unreacted isocyanate group or a constitutional unit containing a basic nitrogen-containing group bonded through a linking group formed by reaction of an isocyanate group with a functional group reactive therewith, Z independently denotes a constitutional unit containing a basic nitrogen-containing group bonded through a linking group formed by reaction of a carbodiimide group and a functional group reactive therewith, M denotes the number of the constituent units Z in the molecule and is an integer of 0 or more, and (N-L-M) also denotes an integer of 0 or more. A is omitted in this formula.

The formulas (4) and (5) symbolically show only main portions, and although the structures in which the constituent units of X and Z are respectively continued are shown as a typical structure, structures in which X, Z, and —(N=C=N)— are bonded at random are also included.

Furthermore, when M is an integer of one or more, namely, there is at least one basic nitrogen-containing group in the formula (5), the portion of Y in the formula (5) is other than a basic nitrogen-containing group and may be a constituent unit bonded through a linking group by a similar reaction of a compound reactive with the isocyanate group. The compound having a functional group reactive with the isocyanate group is preferably a compound which is low in the reactivity with the carbodiimide group and reacts selectively with the isocyanate group prior to the carbodiimide group, and examples of the compounds include low molecular weight monoalcohol compounds such as methanol, ethanol and the like.

The linking group formed at the time of introducing the above-mentioned side chain by reaction of the functional group reactive with the carbodiimide group is generally formed by reaction of the carbodiimide group with a carboxyl group, a sulfonic acid group, a phosphoric acid group, a hydroxyl group, an amino group, or the like and has the following structure.

For example, the linking group formed by reaction of the carbodiimide group and the carboxyl group is expressed by the following formula (6) or (7), the linking group formed by reaction of the carbodiimide group and the hydroxyl group is expressed by the following formula (8) or (9), the linking group formed by reaction of the carbodiimide group and the amino group is expressed by the following formula (10), the linking group formed by reaction of the carbodiimide group and the sulfonic acid group is expressed by the following formula (11), and the linking group formed by reaction of the carbodiimide group and the phosphoric acid group is expressed by the following formula (12).

Further, the linking group formed by reaction of the isocyanate group with the reactive functional group is generally formed by reaction of the isocyanate group with the hydroxyl group, the primary amino group, the secondary amino group or the like.

For example, the linking group formed by reaction of the isocyanate group and the hydroxyl group is expressed by the following formula (13) and the linking group formed by reaction of the isocyanate group with the primary or secondary amino group is expressed by the following formula (14).

[Chem. 1]

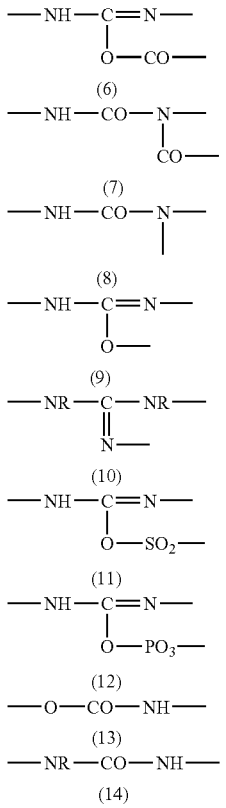

In the above-mentioned formulas, R denotes a hydrogen atom or a hydrocarbon group having one or more carbon atoms.

As described above, the carbodiimide compound of the present invention is a compound having a constituent unit denoted as X in the formula (4) and formed by introducing at least one polyester side chain into the carbodiimide group portion of the carbodiimide compound expressed by, for example, the formula (1), which is a starting material, through the linking group expressed by any one of the formulas (6) to (12). Furthermore, it is preferable that by introducing a basic nitrogen-containing group or other functional side chains similarly, the carbodiimide compound of the present invention is a compound having a constituent unit denoted as Z in the formula (5), a compound formed by introducing a basic nitrogen-containing group, a functional side chain or the like into both ends or one end of the molecule through a linking group expressed by the formula (13) or (14), and a compound having a carbodiimide group remaining in the molecule.

The carbodiimide compound of the present invention has excellent dispersibility of the toner particles by having a polyester side chain and a basic nitrogen-containing group, and when it is used for the liquid developer, it is possible to achieve a balance between maintenance of an insulating property or a charging characteristic and the dispersibility of the pigment or the toner particles.

3) Method for Producing Carbodiimide Compound

When the carbodiimide compound of the present invention is produced using the above-mentioned materials, for all reactions, namely the reaction between the carbodiimide group and the carboxyl group or the like, and the reaction between the isocyanate group and the hydroxyl group or the like as a reaction for introducing the side chain, normal methods can be employed. Furthermore, the order of introducing the polyester side chain, the basic nitrogen-containing group or the like is not particularly limited, and for example when two or more species of compounds having the functional group reactive with the carbodiimide group are used, these compounds can be added separately or can be added simultaneously to be reacted, and also when two or more species of compounds having the functional group reactive with the isocyanate group are used, these compounds can be added separately or can be added simultaneously to be reacted. For example, when a dispersant is produced using three components of (1) a carbodiimide compound, (2) a compound having (a) a functional group reactive with the carbodiimide group, and (b) a functional group capable of linking with the polyester side chain, and (3) a compound to form the polyester side chain and having a functional group reactive with the functional group described in the above-mentioned (2) (b), the polyester side chain in the resulting dispersant is "a polyester side chain introduced through a reaction with the carbodiimide group" whether the compounds (1) and (2) are previously reacted and the resulting product is reacted with the compound (3), or the compounds (2) and (3) are previously reacted and the resulting product is reacted with the compound (1).

Further, when a compound having the functional group reactive with the carbodiimide group and a compound having the functional group reactive with the isocyanate group are used, the compounds may be reacted with the carbodiimide group first, or may be reacted with the isocyanate group first if the same compounds are ultimately obtained.

In addition, it is preferable that species and ratios of the polyester side chain and the basic nitrogen-containing group, which are introduced into a molecule, and further the number of remaining carbodiimide groups are appropriately established according to species of a pigment or a dispersion medium, for example, in the case of being used as a liquid developer and performance required in other application fields to mix the respective materials so that the carbodiimide compound finally becomes a compound having well-balanced performance.

The carbodiimide compound having the polyester side chain and the basic nitrogen-containing group in its molecule, which is obtained by reacting materials described above, preferably contains the basic nitrogen-containing group in an amount of 0.02 to 4 mmol, and more preferably in an amount of 0.05 to 3 mmol per 1 g of the carbodiimide compound. When the amount of the basic nitrogen-containing group per 1 g of the carbodiimide compound is within the above-mentioned range, good dispersion stability is attained.

A number average molecular weight of the carbodiimide compound of the present invention obtained from the materials and the methods of production described above is preferably 1000 or more, and 100000 or less. When the number average molecular weight is too large, a liquid developer having a proper viscosity may not be obtained in making the liquid developer from the carbodiimide compound and it is unfavorable particularly when a high concentration liquid developer is needed. On the other hand, when the number average molecular weight is too small, the dispersion stability of a pigment in the liquid developer may be deteriorated and this is not preferred. The number average molecular weight is more preferably 1000 or more, and 50000 or less.

It is necessary that an adequate covalent bond and an adequate adsorption force act in the dispersant so that the dispersant does not leave the surface of the pigment or the toner particles with time, and therefore it is preferable to adjust the carbodiimide equivalent weight and the amount of the basic nitrogen-containing group depending on pigments or resins composing the toner particles to be used. Further, it is preferable that the polyester side chain itself is soluble in an insulating hydrocarbon organic solvent in terms of maintaining better dispersion stability of the pigment and the toner particles.

The carbodiimide compound is preferably a compound with a carbodiimide equivalent weight of 100 to 50000. Herein, the term carbodiimide equivalent weight refers to a number expressed by (a number average molecular weight of a carbodiimide compound)/(a number of carbodiimide groups in a carbodiimide compound molecule). When the carbodiimide equivalent weight of the carbodiimide compound is too high, a weight ratio of the polyester side chain to the whole molecule of the carbodiimide compound decreases, and the dispersion stability of the pigment may be deteriorated. On the other hand, a compound with a small carbodiimide equivalent weight value is favorable in that a weight ratio of the polyester side chain or a side chain having each functionality to the whole molecule of the carbodiimide compound can be enhanced, however, the synthesis of the carbodiimide compound itself and the control of a reaction for introducing a side chain may become difficult. A more preferable carbodiimide equivalent weight is at least 200 and at most 10000.

The carbodiimide compounds may be used singly or may be used in combination of two or more species of them in the liquid developer of the present invention.

The total content ratio of the pigment, the dispersant and the resin in the liquid developer of the present invention is preferably 5 to 50% by weight. If the total content ratio is less than 5% by weight, an adequate image density may not be attained. If the total content ratio is more than 50% by weight, a problem that the viscosity of the liquid developer becomes too high may arise.

Next, a method of producing the liquid developer of the present invention will be described.

The liquid developer of the present invention is produced using a coacervation method.

The "coacervation method" is a method in which in a mixed liquid of a solvent which is a good solvent for a resin and a solvent which is a poor solvent for a resin, by changing a mixing ratio of one solvent to the other solvent, the resin is shifted from a dissolved state to a precipitated state and in the meantime a pigment being a coloring agent is encapsulated in the resin to form colored resin particles.

In the present invention, a method, in which an organic solvent is removed from a mixed liquid of the organic solvent for dissolving a resin in which a coloring agent is dispersed and the resin is dissolved, and the hydrocarbon insulating medium in which the resin is not dissolved, to precipitate the resin so as to encapsulate the coloring agent and thereby the colored resin particles are dispersed in the hydrocarbon insulating medium, is employed.

Specifically, first, a pigment, a dispersant, and a part of the organic solvent are mixed, and the pigment is disperded by media type dispersing machines, for example, an Attritor, a ball mill, a sand mill, a bead mill or the like, or non-media type dispersing machines, for example, a high-speed mixer or a high-speed homogenizer to obtain a pigment dispersion. Furthermore, the resin and the rest of the organic solvent are added to this pigment dispersion, and then the hydrocarbon insulating medium is added while stirring the resulting mixture with a high-speed shear stirrer, and thereby a mixed liquid can be obtained. When the pigment dispersion is prepared, the resin may be added in advance and then the pigment may be dispersed.

Next, the organic solvent is distilled off while stirring the mixture with the high-speed shear stirrer, and thereby the liquid developer of the present invention can be obtained. Further, if the concentration of solid matters in the resulting liquid developer is high, the hydrocarbon insulating medium may be further added so that the required concentration of solid matters is achieved. Further, other additives such as a charge control agent and the like may be added as required. In addition, the liquid developer of the present invention may be obtained by simultaneously performing distilling off of the organic solvent and the addition of the hydrocarbon insulating medium.

As the organic solvent for dissolving a resin used in the present invention, a solvent having a SP value of 8.5 or more is preferable and solvents having a low boiling point which are easy to distill off from the mixed liquid by distillation are more preferable, and examples of the solvents having a low boiling point include ethers such as tetrahydrofuran; ketones such as methyl ethyl ketone and cyclohexanone; and esters such as ethyl acetate, and further aromatic hydrocarbons such as toluene and benzene can also be used when the solvent has the ability to dissolve the resin. These organic solvents may be used singly or may be used in combination of two or more species.

As the high-speed shear stirrer, equipment, which can perform stirring and can exert a shear force, such as a homogenizer or a homomixer can be used. In these high-speed shear stirrers, there are various types of capacities, number of revolutions and models, however, appropriate equipment may be used depending on production patterns. The number of revolutions in using a homogenizer is preferably 500 revolutions per one minute (rpm) or more.

The hydrocarbon insulating medium used in the present invention is preferably a medium in which the above-mentioned resin is not dissolved and which has electrical insulating properties and a lower solubility parameter (SP) (preferably an SP value of less than 8.5) than the above-mentioned organic solvent and does not volatilize in distilling off the organic solvent. Examples of the hydrocarbon insulating medium satisfying such conditions include nonvolatile or low volatile hydrocarbons, and more preferable hydrocarbons are aliphatic hydrocarbons and alicyclic hydrocarbons. Furthermore, aromatic hydrocarbons and halogenated hydrocarbons can be used as long as they are hydrocarbons in which the above-mentioned resin is not dissolved and their SP values satisfy the above-mentioned range of SP value. Among others, paraffinic media having a high boiling point (a boiling point of 150° C. or higher) such as a normal paraffinic medium, an isoparaffinic medium, a cycloparaffinic medium and a mixture of two or more species thereof are preferable from the viewpoint of odor, harmlessness and cost. Examples of commercially available paraffinic media having a high boiling point such as a normal paraffinic medium, an isoparaffinic medium, a cycloparaffinic medium and a mixture thereof include Isoper G, Isoper H, Isoper L and Isoper M, Exxsol D130 and Exxsol D140 (all manufactured by Exxon Chemical K. K.), Shellsol 71 (manufactured by Shell Sekiyu), IP Solvent 1620, IP Solvent 2028 and IP Solvent 2835 (all manufactured by Idemitsu Petrochemical Co., Ltd.), MORESCO WHITE P-40, MORESCO WHITE P-55 and MORESCO WHITE P-80 (all liquid paraffin manufactured by MATSUMURA OIL RESEARCH Corp.), and liquid paraffin No. 40-S and liquid paraffin No. 55-S (both liquid paraffin manufactured by Chuokasei Co., Ltd.).

In addition, the content ratio of the hydrocarbon insulating medium in the liquid developer of the present invention is preferably 50 to 95% by weight.

The average particle diameter of the colored resin particles in the liquid developer obtained by the coacervation method is generally 0.1 to 5.0 μm, and preferably 0.1 to 3.0 μm.

The liquid developer of the present invention may further contain a charge control agent as required in addition to these materials, and the charge control agent is broadly divided into the following two types of (1) and (2).

(1) A type in which the surface of the toner particles is ionized or coated with a substance capable of adsorbing ions. As this type of materials, fats and oils such as linseed oil and soybean oil, alkyd resins, halogenated polymers, aromatic polycarboxylic acids, acid group-containing water-soluble dyes, an oxidized condensate of aromatic polyamine and the like are suitable.

(2) A type in which a substance, which is dissolved in the hydrocarbon insulating medium and can give ions to and receive ions from the toner particles, coexists with the liquid developer. As this type of materials, metallic soaps such as cobalt naphthenate, nickel naphthenate, iron naphthenate, zinc naphthenate, cobalt octoate, nickel octoate, zinc octoate, cobalt dodecylate, nickel dodecylate, zinc dodecylate and cobalt 2-ethylhexanoate; metal sulfonate salts such as petroleum metal sulfonate salts and metal salts of sulfosuccinates; phospholipids such as lecithin; metal salicylate salts such as a metal t-butyl salicylate complex; a polyvinylpyrrolidone resin, a polyamide resin, a sulfonic acid-containing resin, hydroxybenzoic acid derivatives and the like are suitable.

Further, in addition to these, other additives may be added as required.

Since the liquid developer of the present invention minimizes the adverse effect on electric resistance and the charging characteristic of toner particles and is superior in the dispersibility of a pigment and the dispersion stability of the toner particles, it can be used as a liquid developer for electrophotography or electrostatic recording used in printing machines, copiers, printers and facsimiles.

EFFECTS OF THE INVENTION

By using the dispersant and the resin of the present invention, which can be applied to any liquid developers using pigments, a liquid developer can be obtained, in which the adverse effect on electric resistance of the liquid developer and the electrophoretic property or the charging characteristic of toner particles is minimized and the dispersibility of a pigment and the dispersion stability of the toner particles are improved.

BEST MODE FOR CARRYING OUT THE INVENTION

Hereinafter, the liquid developer of the present invention will be described in more detail by way of examples, however, the present invention is not limited to these examples as long as not departing from its spirit and scope. In the following descriptions, "part (s)" and "%" refer to "part(s) by weight" and "% by weight", unless otherwise specified.

<Pigment>

As a pigment, MA285 (carbon black manufactured by Mitsubishi Chemical Corporation) was used.

Synthesis Example 1

Dispersant 1

Into a four necked flask equipped with a reflux condenser tube, a nitrogen gas inlet tube, a stirring rod and a thermometer, 132.6 parts of a toluene solution (solid content 50%) of a polycarbodiimide compound with a carbodiimide equivalent weight of 316 having an isocyanate group and 12.8 parts of N-methyldiethanolamine were charged, and the resulting mixture was maintained at about 100° C. for 3 hours to react the isocyanate group with a hydroxyl group. Then, 169.3 parts of a self-polycondensate of 12-hydroxystearic acid having a number average molecular weight of 1600, which has a carboxyl group at its end, was charged, and the resulting mixture was maintained at about 80° C. for 2 hours to react a carbodiimide group with the carboxyl group, and then toluene was distilled off under a reduced pressure to obtain a pigment dispersant 1 (solid content 100%) with a carbodiimide equivalent weight of 2400 having a number average molecular weight of about 9300 and containing 0.4188 mmol of a basic nitrogen-containing group.

Synthesis Example 2

Dispersant 2

A pigment dispersant 2 (solid content 100%) with a carbodiimide equivalent weight of 2786 having a number average molecular weight of 11492 and containing 0.3386 mmol/g of a basic nitrogen-containing group was obtained by the same method as in Synthesis Example 1 except for changing the self-polycondensate of 12-hydroxystearic acid having a number average molecular weight of 1600, which has a carboxyl group at its end, to a ring-opening product of polycaprolactone having a number average molecular weight of 2000, which has a carboxyl group at its end.

<Comparative Pigment Dispersant>

As a comparative pigment dispersant, Ajisper PB821 (manufactured by Ajinomoto Fine-Techno Co., Inc.) was employed.

<Resin>

Resins 1 to 4 were obtained by polymerizing monomers having a composition (molar ratio) shown in Table 1, respectively.

TABLE 1

| | Monomer | | | | | | |
|---|---|---|---|---|---|---|---|
| Resin No. | St | BzMA | SMA | MMA | AA | Mw | Av |
| Resin 1 | 85.0 | — | 5.0 | — | 10.0 | 68000 | 50 |
| Resin 2 | 19.0 | 30.0 | 8.0 | 7.0 | 36.0 | 10000 | 150 |
| Resin 3 | 93.0 | 5.0 | — | — | 2.0 | 60000 | 10 |
| Resin 4 | 80.0 | — | 5.0 | — | 15.0 | 52000 | 76 |

Abbreviations in Table 1 has the following meanings; St: styrene, BzMA: benzyl methacrylate, SMA: stearyl methacrylate, MMA: methyl methacrylate, AA: acrylic acid, Mw: weight average molecular weight, and Av: acid value.

Production of Liquid Developer

Example 1

10 parts of MA285, and 1 part of the above dispersant 1,1 part of the above dispersant 2 and 88 parts of tetrahydrofuran (SP value 9.1, hereinafter, referred to as "THF") as dispersants were mixed, and the resulting mixture was kneaded for 15 minutes with a paint shaker using steel beads of 5 mm in diameter and then further kneaded for 2 hours with EIGER Motor Mill M-250 (manufactured by EIGER Japan K. K.) using zirconia beads of 0.5 mm in diameter. To 50 parts of this kneaded mixture, 8 parts of the resin 1 was added, and the resulting mixture was diluted with 42 parts of THF. The diluted mixture was stirred while being diluted with 86 parts of MORESCO WHITE P-40 (manufactured by MATSUMURA OIL RESEARCH Corp., SP value less than 8.5, boiling point 260° C.) to obtain a mixed liquid. Next, using an apparatus in which a solvent distilling off apparatus (connected to a pressure reducing equipment) is connected to a homogenizer equipped with a hermetically sealed stirring vessel, the pressure of the mixed liquid was reduced in such a way that the temperature of the mixed liquid is 50° C. by the pressure reducing equipment while stirring the mixed liquid at high speed (number of revolution 5000 rpm) with the homogenizer. The THF was distilled off completely out of the hermetically sealed stirring vessel to obtain a liquid developer (solid content concentration 14%) of Example 1.

Example 2

A liquid developer of Example 2 was obtained by the same method as in Example 1 except for changing the dispersants to the dispersant 1 alone.

Example 3

A liquid developer of Example 3 was obtained by the same method as in Example 1 except for changing the resin to the resin 3.

Example 4

A liquid developer of Example 4 was obtained by the same method as in Example 1 except for changing the resin to the resin 4.

Comparative Example 1

A liquid developer of Comparative Example 1 was obtained by the same method as in Example 1 except for changing the resin to the resin 2.

Comparative Example 2

A liquid developer of Comparative Example 2 was obtained by the same method as in Example 1 except for changing the dispersants to Ajisper PB821 alone.

<Evaluation Method>

Each liquid developer was evaluated according to the following evaluation method. The results are shown in Table 2.

(Viscosity)

The viscosity at 25° C. was measured in terms of the viscosity after 60 seconds with an E type viscometer (manufactured by Toki Sangyo Co., Ltd., 50 rpm).

(Particle Size)

Particle sizes (average particle diameters of the colored resin particles) were visually measured using an optical microscope BH-2 (manufactured by Olympus Corp.).

(Charging Property and Electrophoretic Property)

Particles were observed using a migration cell (conditions: distance between electrodes: 80 μm, applied voltage: 200 V).

○: Particles migrate smoothly without agglomerating

Δ: Particles migrate while forming agglomerates x: Particles agglomerate between electrodes and do not move As for the charging property, when 90% or more of the toner particles migrate to the negative electrode side in applying a voltage to the migration cell, the charging property was rated as "+". When 90% or more of the toner particles migrate to the positive electrode side in applying a voltage to the migration cell, the charging property was rated as "−". And, cases other than these cases were rated as "±".

In Comparative Example 2, since agglomeration was intensive, the charging property could not be evaluated.

TABLE 2

| | Dispersant used/resin | Viscosity (mPa · s) | Particle size (μm) | Charging property | Electrophoretic property |
|---|---|---|---|---|---|
| Example 1 | dispersants 1 and 2/ resin 1 | 7.1 | 1 to 2.5 | + | ○ |
| Example 2 | dispersant 1/resin 1 | 7.2 | 1 to 2 | + | ○ |
| Example 3 | dispersants 1 and 2/ resin 3 | 12.1 | 1 to 2 | + | ○ |
| Example 4 | dispersants 1 and 2/ resin 4 | 7.0 | 1 to 3 | + | ○ |
| Comparative Example 1 | dispersants 1 and 2/ resin 2 | 7.7 | 1 to 2 | ± | Δ |

TABLE 2-continued

| | Dispersant used/resin | Viscosity (mPa · s) | Particle size (μm) | Charging property | Electrophoretic property |
|---|---|---|---|---|---|
| Comparative Example 2 | PB821/resin 1 | 9.7 | 2 to 4 | (*) | X |

(*) In Comparative Example 2, since agglomeration was intensive, the charging property could not be evaluated.

The invention claimed is:

1. A liquid developer formed by dispersing colored resin particles comprising at least a pigment, a dispersant and a resin in a hydrocarbon insulating medium using a coacervation method, wherein said dispersant is a carbodiimide compound having at least one basic nitrogen-containing group and at least one polyester side chain introduced through a reaction with a carbodiimide group in its molecule, and said resin is an acid group-containing resin and the acid value of the resin is 1 to 100.

2. The liquid developer according to claim 1, wherein said dispersant is a carbodiimide compound containing a basic nitrogen-containing group in an amount of 0.02 to 4 mmol per 1 g of the compound.

3. The liquid developer according to claim 1, wherein said dispersant is a carbodiimide compound having a basic nitrogen-containing group on the main chain.

4. The liquid developer according to claim 1, wherein said basic nitrogen-containing group is a tertiary amino group.

5. The liquid developer according to claim 1, wherein said dispersant is a carbodiimide compound with a carbodiimide equivalent weight of 100 to 50000.

6. The liquid developer according to claim 1, wherein said resin is a carboxyl group-containing resin.

7. The liquid developer according to claim 1, wherein said hydrocarbon insulating medium is a high boiling point paraffin having a boiling point of 150° C. or higher.

8. A method of producing the liquid developer according to claim 1, comprising the step of obtaining a mixed liquid containing at least a pigment, a dispersant, a resin, an organic solvent for dissolving said resin and a hydrocarbon insulating medium, and the step of distilling off the organic solvent contained in said mixed liquid, wherein said dispersant is a carbodiimide compound having at least one basic nitrogen-containing group and at least one polyester side chain introduced through a reaction with a carbodiimide group in its molecule, and said resin is an acid group-containing resin and the acid value of the resin is 1 to 100.

* * * * *